US006771149B2

(12) United States Patent
Hiroshima et al.

(10) Patent No.: US 6,771,149 B2
(45) Date of Patent: Aug. 3, 2004

(54) DIELECTRIC FILTER, DIELECTRIC DUPLEXER, AND COMMUNICATION DEVICE

(75) Inventors: Motoharu Hiroshima, Ishikawa-ken (JP); Jun Toda, Shiga-ken (JP); Hideyuki Kato, Ishikawa-ken (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 10/242,647

(22) Filed: Sep. 13, 2002

(65) Prior Publication Data

US 2003/0052753 A1 Mar. 20, 2003

(30) Foreign Application Priority Data

Sep. 14, 2001 (JP) ..... 2001-279804
Jul. 26, 2002 (JP) ..... 2002-218274

(51) Int. Cl.[7] ..... H01P 1/20; H01P 3/06; H01P 7/04

(52) U.S. Cl. ..... 333/206; 333/222

(58) Field of Search ..... 333/206, 26, 134, 333/202, 222, 204

(56) References Cited

U.S. PATENT DOCUMENTS 6,507,250 B1 * 1/2003 Tada et al. ..... 333/134

FOREIGN PATENT DOCUMENTS

| | | | |
|---|---|---|---|
| EP | 688059 | * | 6/1995 |
| EP | 0 986 124 | A2 | 3/2000 |
| EP | 1 001 479 | A1 | 5/2000 |
| EP | 1 098 384 | A2 | 5/2001 |
| EP | 1294042 | * | 3/2003 |
| JP | 2000-349505 | | 12/2000 |

OTHER PUBLICATIONS

Japanese Patent Abstract Publication No. 2000–353904, published Dec. 19, 2000.

Japanese Patent Abstract Publication No. 2001–136003, published May 18, 2001.

Copy of European Search Report dated Oct. 9, 2003.

* cited by examiner

*Primary Examiner*—Patrick Wamsley
(74) *Attorney, Agent, or Firm*—Dickstein, Shapiro, Morin & Oshinsky, LLP.

(57) ABSTRACT

In a dielectric block, an array of three excitation holes, in each of which one opening is a short-circuited end and the other opening is an open-circuited end, are disposed so as to be interdigitally coupled and balanced input-output terminals are provided at the opening of the excitation holes at both ends of the array. A resonator hole is provided so as to be coupled to one excitation hole of the excitation holes at either end of the array. Thus, a compact dielectric filter with balanced input-output terminals is constructed.

10 Claims, 11 Drawing Sheets

DIELECTRIC FILTER, DIELECTRIC DUPLEXER, AND COMMUNICATION DEVICE

BACKGROUND OF THE INVENTION

1. Field of the Invention

The present invention relates to a dielectric filter and dielectric duplexer used in the microwave band, etc., and to a communication device provided with the dielectric filter or the dielectric duplexer.

2. Description of the Related Art

Up to now, dielectric filters in which internal-conductor-formed holes are provided inside a dielectric block and an external conductor is formed on the outside surface of the dielectric block and which is composed of one stage or a plurality of stages of resonators have been for filters in the microwave band, etc.

In a dielectric filter using such a dielectric block, input-output terminals, which are capacitively coupled to internal conductors, are provided on the outside surface of the dielectric block for inputting and outputting unbalanced signals. Therefore, for example, in order to supply signals to a balanced-input amplifier, unbalanced signals are converted to balanced signals by using a balun (unbalanced-to-balanced converter). However, in such a construction, there are problems in that the insertion loss due to the balun is large and, since a space for the balun is required on the circuit board, the filter cannot be made smaller.

The applicant of the present invention has filed Japanese Patent Application No. 11-314657 and Japanese Patent Application No. 2000-036302 for dielectric filters in which balanced signals can be input and output without any outside help.

In related dielectric filters having balanced input-output terminals, since the axial length of each resonator is long, the required mounting area on a mounting board is inevitably increased. Furthermore, since the balanced input-output terminals are disposed in the vicinity of both open ends of a half wavelength resonator, there is a problem in that the design freedom of the space between balanced input-output terminals is low.

SUMMARY OF THE INVENTION

Accordingly, it is an object of the present invention to provide a dielectric filter and dielectric duplexer in which the above problems are solved and the freedom for arranging balanced input-output terminals is increased and which are small as a whole. It is also an object of the present invention to provide a communication device using the dielectric filter or the dielectric duplexer.

According to the present invention, a dielectric filter comprises a dielectric block; an array of three excitation holes provided inside the dielectric block, one opening of each hole being a short-circuited end and the other opening or the vicinity of the other opening being an open-circuited end, the three excitation holes being interdigitally coupled in order along the array; balanced input-output terminals provided at the open-circuited ends of the excitation holes at both ends of the array of three excitation holes; and a resonator hole which is coupled to at least one of the excitation holes at an end of the array of three excitation holes and in which one opening forms a short-circuited end and the other opening or the vicinity of the other opening forms an open-circuited end, the resonator hole being provided inside the dielectric block.

In this way, the array of three excitation holes and the resonator hole coupled to at least one of the excitation holes at an end of the three excitation holes have an axial length substantially equal to a quarter wavelength and, as a result, the dielectric filter can be made smaller as a whole. Furthermore, since the above balanced input-output terminals are provided in the open-circuited ends of the excitation hole at either end of the array of three excitation holes, the terminals can be disposed in a relatively small area.

Furthermore, according to the present invention, a dielectric duplexer comprises a first dielectric filter which is a dielectric filter having the above construction; a second dielectric filter containing another resonator hole which is different from the resonator hole of the first dielectric filter, the second dielectric filter being formed in the dielectric block having the first dielectric filter; a common input-output terminal coupled to the first and second dielectric filters, the common input-output terminal being formed on the dielectric block; and an input-output terminal coupled to the second dielectric filter, the input-output terminal being formed on the dielectric block.

Because of this construction, the dielectric duplexer can be used as an antenna-sharing device, for example, in which a filter to input or output a signal through the balanced input-output terminal is provided.

Furthermore, according to the present invention, in a dielectric duplexer, the input-output terminal coupled to the second dielectric filter and the common input-output terminal are unbalanced input-output terminals.

Because of the construction, the dielectric duplexer can be used as an antenna-sharing device, for example, in which a first filter to input or output a signal through the balanced input-output terminals and a second filter to output or input a signal through an unbalanced input-output terminal are provided and an unbalanced signal is input and output through a common input-output terminal.

Furthermore, according to the present invention, in a dielectric duplexer, the common input-output terminal is the balanced input-output terminals having the above construction.

Because of the construction, a balanced input-output type antenna can be directly used.

In an aspect of the present invention, a communication device comprises the above dielectric filter or the above dielectric duplexer.

DESCRIPTION OF THE PREFERRED EMBODIMENTS

The construction of a dielectric filter according to a first embodiment of the present invention is described with reference to FIGS. 1A to 3B.

Figure 1A:
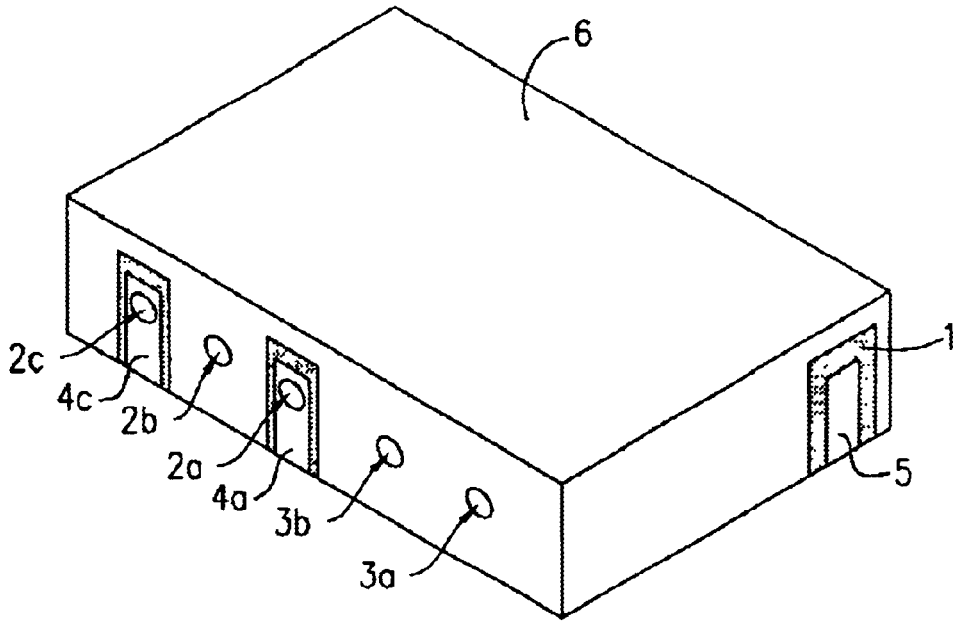
FIGS. 1A and 1B are perspective illustrations of a dielectric filter according to a first embodiment of the present invention.
Figure 1B:
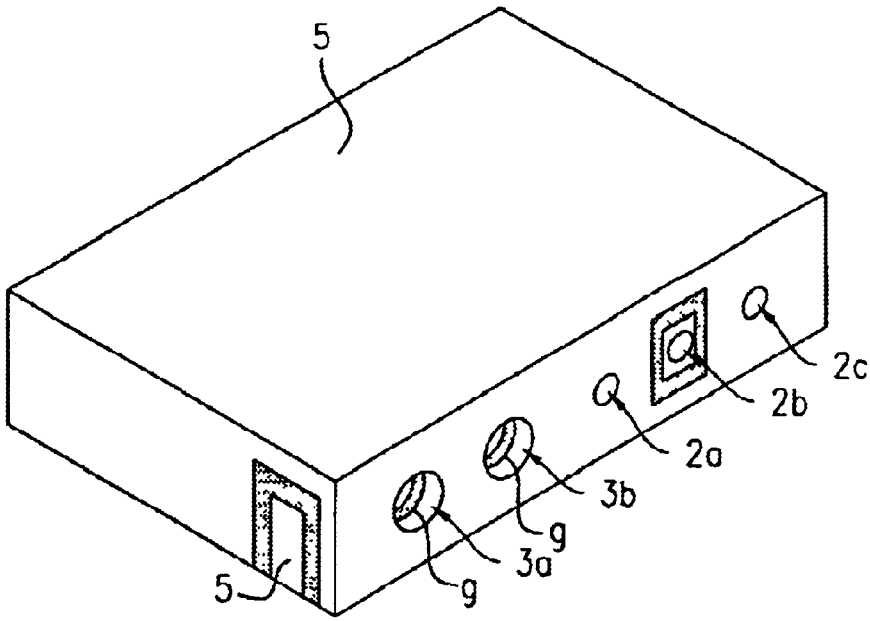

FIGS. 1A and 1B are perspective views of the same dielectric filter and FIG. 1B shows the dielectric filter in FIG. 1A rotated by nearly 90 degrees in the clockwise direction in the horizontal plane. In FIGS. 1A and 1B, in a dielectric block 1, preferably in the form of a substantially rectangular solid block, five holes 2*a,* 2*b,* 2*c,* 3*a,* and 3*b* extending from one surface of the dielectric block 1 to the other opposite surface are provided. A conductor film is formed on the entire inside surface of each hole. Each of the holes 2*a,* 2*b,* and 2*c* functions as an excitation hole and the holes 3*a* and 3*b* function as resonator holes. An internal-conductor-free portion g is provided in the vicinity of one opening of each of the resonator holes 3*a* and 3*b* by removing a part of the internal conductor to make that end open-circuited. Balanced input-output terminals 4*a* and 4*c* are formed at the open-circuited ends of excitation holes 2*a* and 2*c* on the outer surface of the dielectric block 1. Furthermore, an unbalanced input-output terminal 5, to be capacitively coupled, is formed near the open-circuit end of the resonator hole 3*a* on the outside surface of the dielectric block 1. One opening of the excitation hole 2*b,* opposite the open-circuited ends of holes 2*a* and 2*c,* is made open-circuited as shown in FIG. 1B. An external conductor 6 is formed on the outer surface of the dielectric block 1 excluding the vicinity of the balanced input-output terminals 4*a* and 4*c,* the unbalanced input-output terminal 5, and the open-circuit end the excitation hole 2*b.*

Figure 2A:
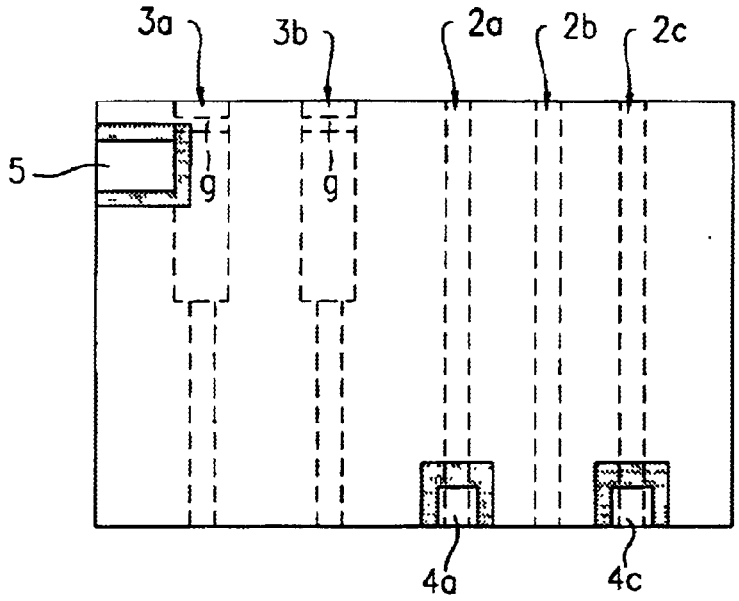
FIG. 2A is a top view of the dielectric filter of the first embodiment.
Figure 2B:
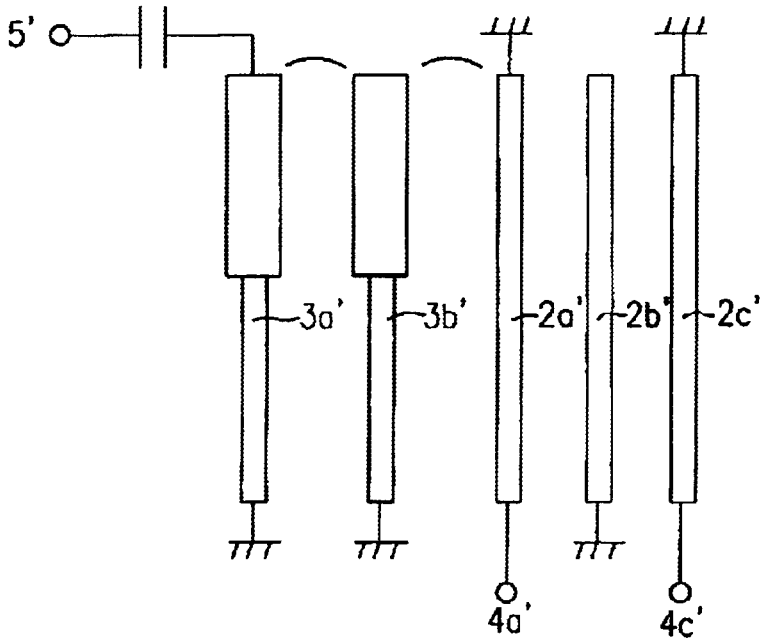
FIG. 2B is an equivalent circuit diagram of the dielectric filter of the first embodiment.

FIG. 2A is a top view of the dielectric filter shown in FIGS. 1A and 1B when seen from the mounting surface side, and FIG. 2B is an equivalent circuit diagram of the dielectric filter. The excitation holes 2*a,* 2*b,* and 2*c* are preferably straight holes in which the inner diameter is nearly constant from one opening to the other, and an interdigital coupling is formed by alternately reversing the direction of the short-circuited and open-circuit ends. The resonator holes 3*a* and 3*b* are preferably stepped holes in which the inner diameter of the open-circuit end provided with the internal-conductor-free portion g is made larger than that of the opposite short-circuited end. The resonator holes 3*a* and 3*b* are capacitively or inductively coupled in accordance with the degree of inductive coupling in the vicinity of the short-circuited ends, the degree of capacitive coupling in the vicinity of the open-circuit ends, and the stray capacitance produced near the internal-conductor-free portion g. The unbalanced input-output terminal 5 is capacitively coupled to the open-circuit end of the resonator 3*a.*

The excitation hole 2*a* is electromagnetically coupled with the neighboring resonator hole 3*b.* The remaining two excitation holes 2*b* and 2*c* form a phase shifter to obtain a phase difference of 180°. That is, a phase difference of 90° can be obtained between the neighboring excitation holes due to the interdigital coupling. Therefore, the phase difference between the balanced input-output terminals 4*a* and 4*c* becomes 180°. Furthermore, the three excitation holes 2*a,* 2*b,* and 2*c* are interdigitally coupled and each set of them can be regarded as a filter having a very large bandwidth. Accordingly the insertion-loss difference between the first excitation hole 2*a* and the third excitation hole 2*c* is very small. As a result, the amplitude difference between the balanced input-output terminals 4*a* and 4*c* is also very small.

Figure 3A:
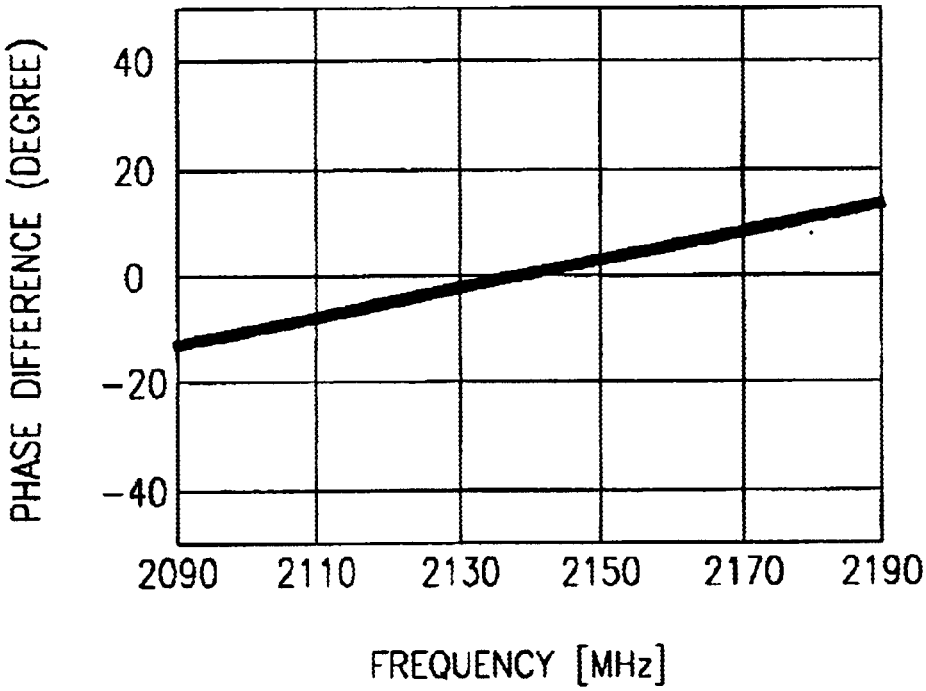
FIGS. 3A and 3B show the balanced characteristics of a balanced input-output terminal of the dielectric filter.
Figure 3B:
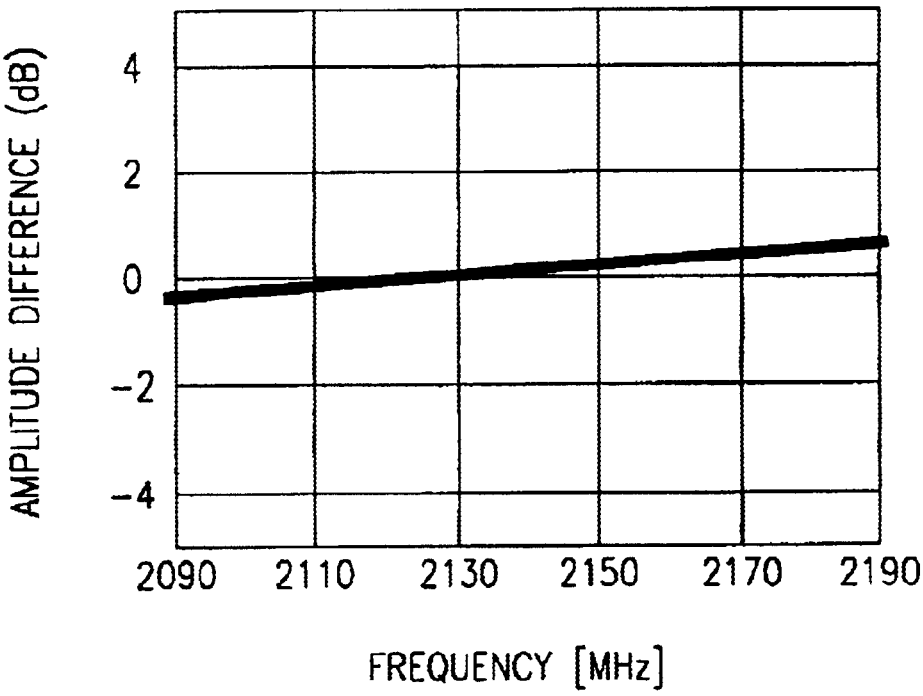

FIGS. 3A and 3B show the phase difference and amplitude difference characteristics between the balanced input-output terminals 4*a* and 4*c* of the above dielectric filter, respectively. The phase difference is within the range of ±15° over a wide band having a center frequency 2140 MHz, i.e., 2140 MHz±50 MHz, and the amplitude difference is within the range of ±1 dB. Thus, excellent balance characteristics can be obtained.

Figure 4:
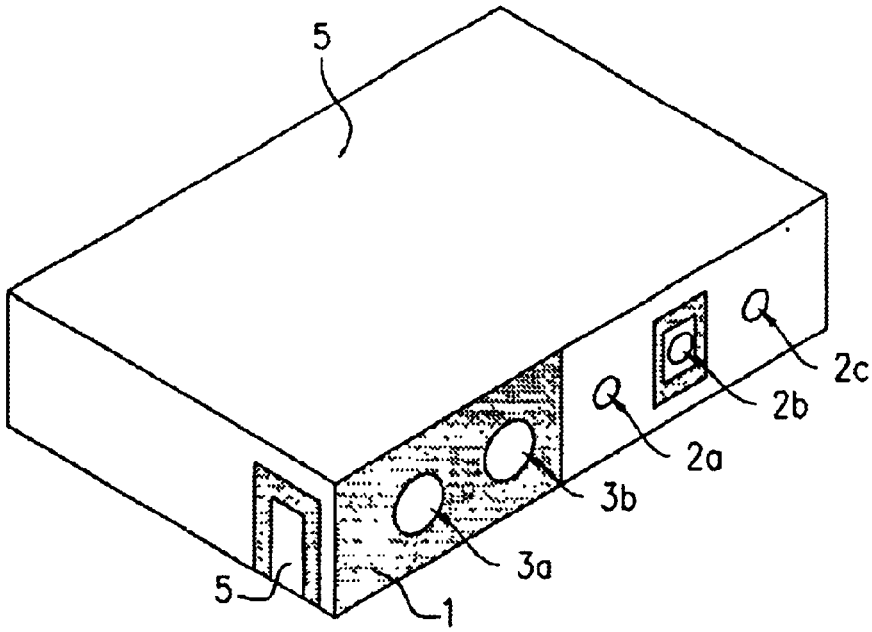
FIG. 4 is a perspective illustration of a dielectric filter according to a second embodiment of the present invention.

FIG. 4 is a perspective illustration of a dielectric filter according to a second embodiment of the present invention. Unlike the dielectric filter shown in FIGS. 1A and 1B, no external conductor 6 is provided at the open-circuited ends of the resonator holes 3*a* and 3*b.* The construction of the other portions is the same as that shown in FIGS. 1A and 1B. This dielectric filter, provided with resonator holes having one opening functioning as an open-circuit end, can be also made smaller as a whole, and the balanced input-output terminals can be lead out in one direction.

Figure 5:
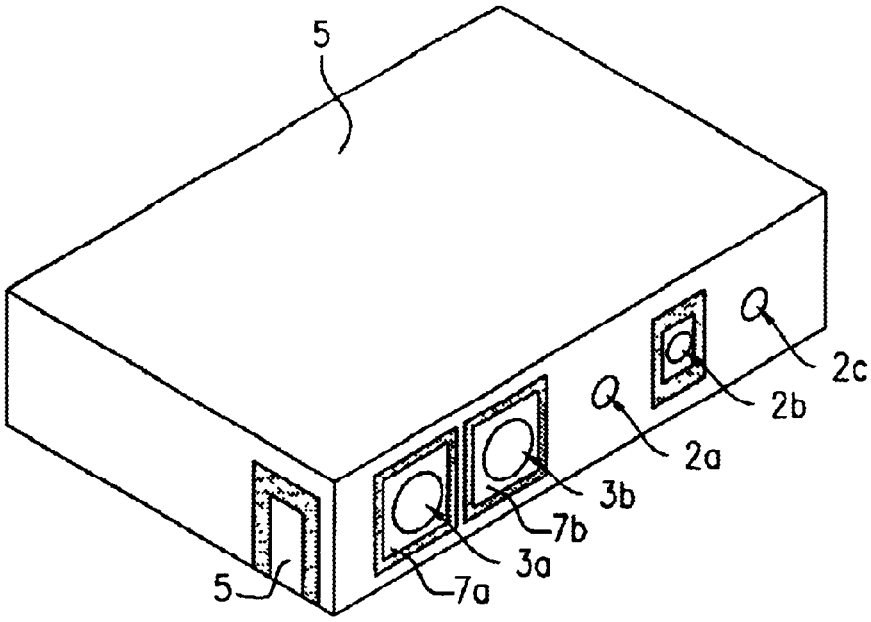
FIG. 5 is a perspective illustration of a dielectric filter according to a third embodiment of the present invention.

FIG. 5 is a perspective illustration of a dielectric filter according to a third embodiment of the present invention. Unlike the dielectric filters shown in FIGS. 1A and 1B and FIG. 4, electrodes 7*a* and 7*b,* electrically connected to the internal conductor of the resonator holes 3*a* and 3*b,* are formed at the open-circuit ends of the resonator holes 3*a* and 3*b,* and the electrodes 7*a* and 7*b* are separated (insulated) from the external conductor 6. Because of such a construction, stray capacitance is produced between the electrodes 7*a* and 7*b* and the external conductor around the electrodes 7*a* and 7*b*. A dielectric filter having such a construction can be also made smaller as a whole, and the balanced input-output terminals can be lead out in one direction.

Figure 6:
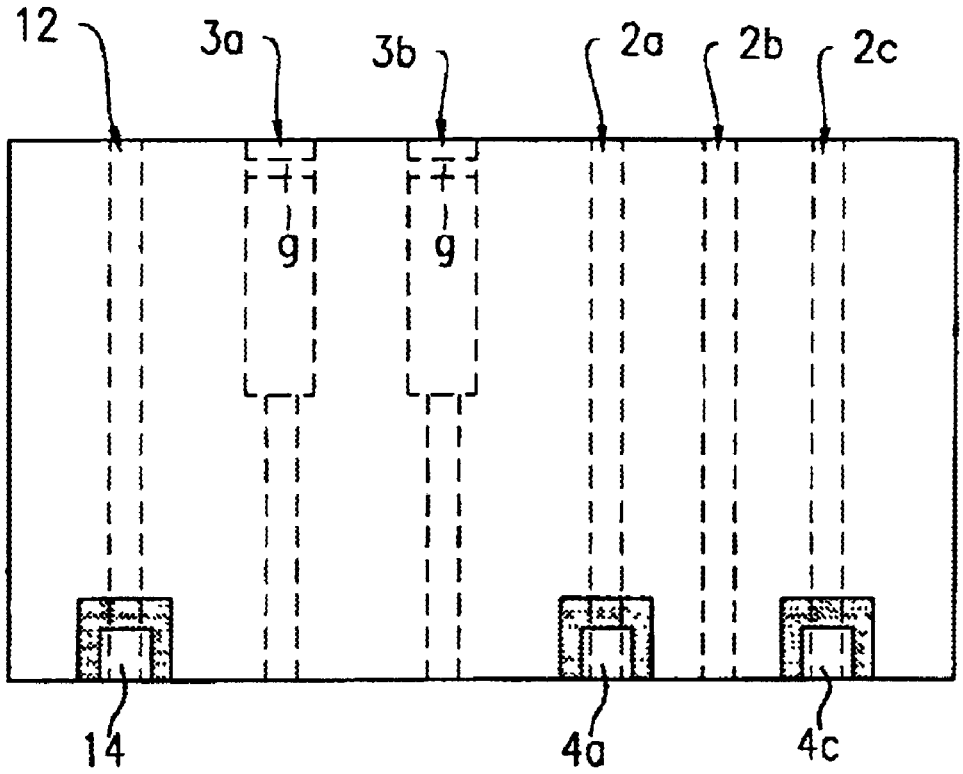
FIG. 6 is a top view of a dielectric filter according to a fourth embodiment of the present invention.

FIG. 6 is a top view of a dielectric filter according to a fourth embodiment of the present invention, when seen from the mounting surface side. Unlike the dielectric filters shown in FIGS. 1A, 1B, 4, and 5, an external conductor is formed on both end faces of the resonator holes 3*a* and 3*b* and the internal-conductor-free portions g are formed in the vicinity of one opening of the resonator holes 3*a* and 3*b.* When constructed in this way, the internal-conductor-free portions g form open-circuit ends of the resonators to produce stray capacitance around the internal-conductor-free portions g. Furthermore, an excitation hole 12 to be coupled to the resonator 3*a* is disposed and an unbalanced input-output terminal 14 is provided at one end of the excitation hole 12. With such a construction, a signal is input and output at the unbalanced input-output terminal 14, and is externally coupled through the excitation hole 12.

A dielectric filter having such a construction can also be made smaller as a whole, and the balanced input-output terminals 4*a* and 4*c* can be lead out in one direction.

Moreover, besides the embodiments described above, for example, a construction in which a coupling electrode for capacitively coupling the neighboring resonator holes may be formed on the surface with the openings shown in FIG. 4.

In the dielectric filters having the above constructions, the balanced input-output terminals 4*a* and 4*c* are used as input terminals and the unbalanced input-output terminal 5 is used as an output terminal. However, the balanced input-output terminals 4*a* and 4*c* may be used as output terminals and the unbalanced input-output terminal 5 may be used as an input terminal.

Furthermore, two resonator holes 3 a and 3*b* are preferably provided in the dielectric block to form a bandpass filter with a two-stage resonator, but a single resonator hole may be provided and coupled to one excitation hole outside of the three excitation holes and may be capacitively coupled to the unbalanced input-output terminal.

Next, the construction of a dielectric duplexer according to an aspect of the present invention is described with reference to FIGS. 7 and 8.

Figure 7:
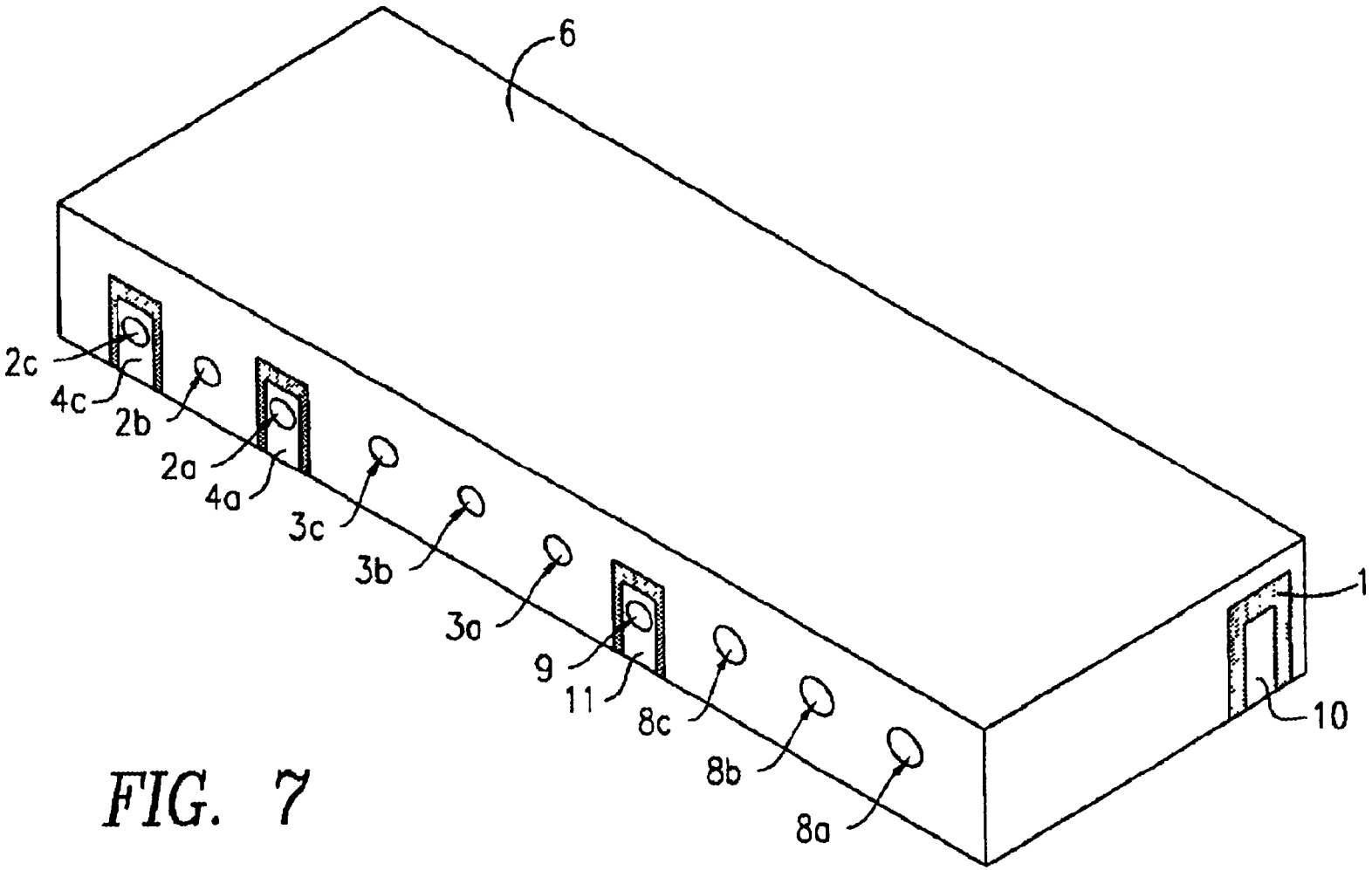
FIG. 7 is a perspective illustration of a dielectric duplexer according to an aspect of the present invention.
Figure 8:
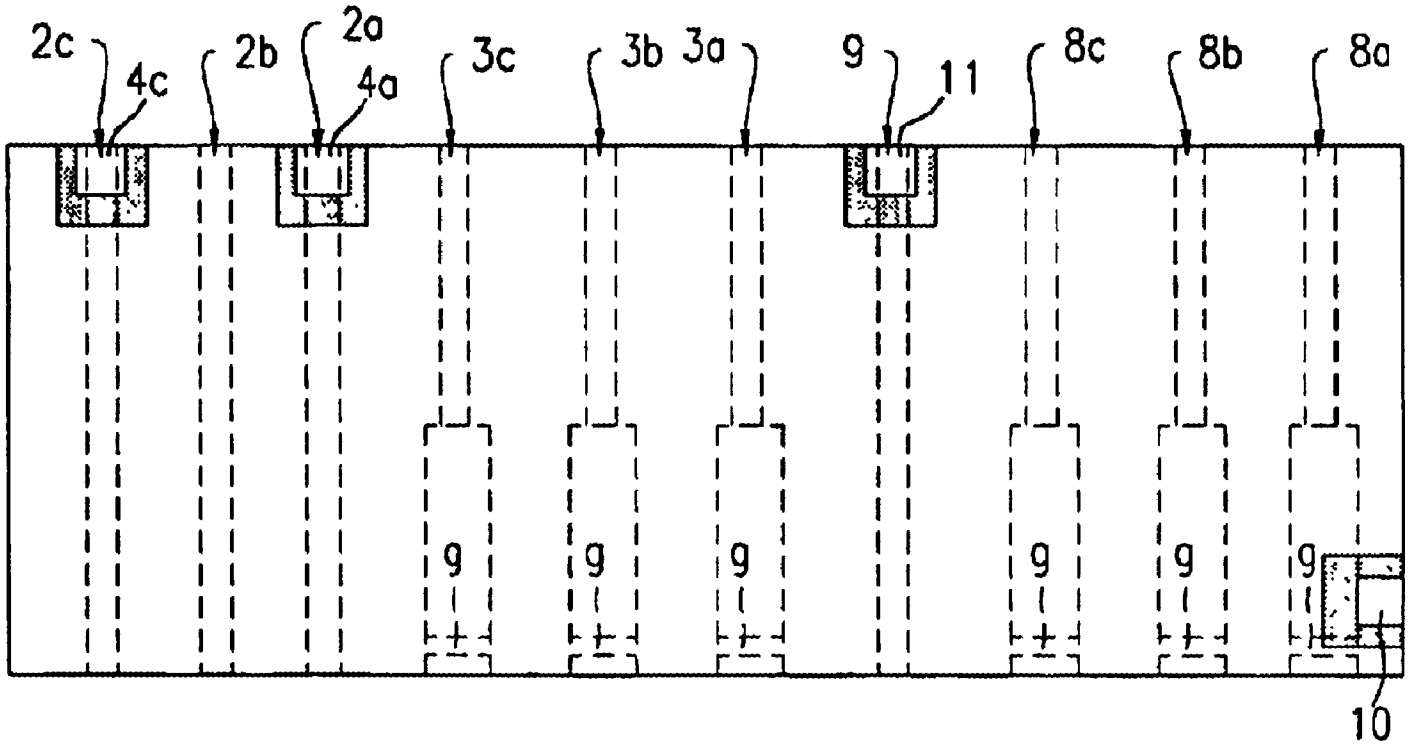
FIG. 8 is a top view of the dielectric duplexer of FIG. 7.

FIG. 7 is a perspective view of the dielectric duplexer and FIG. 8 is a top view of the dielectric duplexer, when seen from the mounting surface side. In a dielectric block 1, preferably in the form of a substantially rectangular solid, ten holes 2*a* to 2*c*, 3*a* to 3*c*, 8*a* to 8*c*, and 9 extend from one surface of the dielectric block 1 to the other opposite surface. The holes 2*a* to 2*c* and 9 are excitation holes and the holes 3*a* to 3*c* and 8*a* to 8*c* are resonator holes. An internal conductor is formed on the inside surface of the excitation holes 2*a* to 2*c* and 9. Furthermore, an internal conductor is formed on the inside surface of the resonator holes 3*a* to 3*c* and 8*a* to 8*c*, and internal-conductor-free portions g are provided in the vicinity of one opening portion of the resonators to form open-circuited ends. An external conductor 6 is formed on the external surface of the dielectric block 1 excluding the areas where the input-output terminals are provided. The construction of the excitation holes 2*a* to 2*c* and the balanced input-output terminals 4*a* and 4*c* is preferably the same as in the dielectric filter shown in each of the above embodiments. The resonator holes 3*a* to 3*c* are preferably stepped holes in which the internal-conductor-free portion g is provided in the vicinity of one opening thereof, and the inner diameter at the open-circuit end is larger than that at the short-circuited end. These three resonator holes 3*a* to 3*c* form a three-stage resonator. In the same way, the three resonator holes 8*a* to 8*c* also form a three-stage resonator. The hole 9 is an excitation hole and an unbalanced input-output terminal 11 is provided at the open-circuit end of the excitation hole 9. Another unbalanced input-output terminal 10 is provided near the open-circuit end of the resonator 8*a* so as to be capacitively coupled to the resonator 8*a*.

When the above unbalanced input-output terminal 10 is used as a transmission-signal input terminal, the balanced input-output terminals 4*a* and 4*b* are used as reception-signal output terminals, and the unbalanced input-output terminal 11 is used as an antenna terminal, the dielectric duplexer functions as an antenna-sharing device.

Next, the construction of a dielectric duplexer according to another aspect of the present invention is described with reference to FIGS. 9 and 10.

Figure 9:
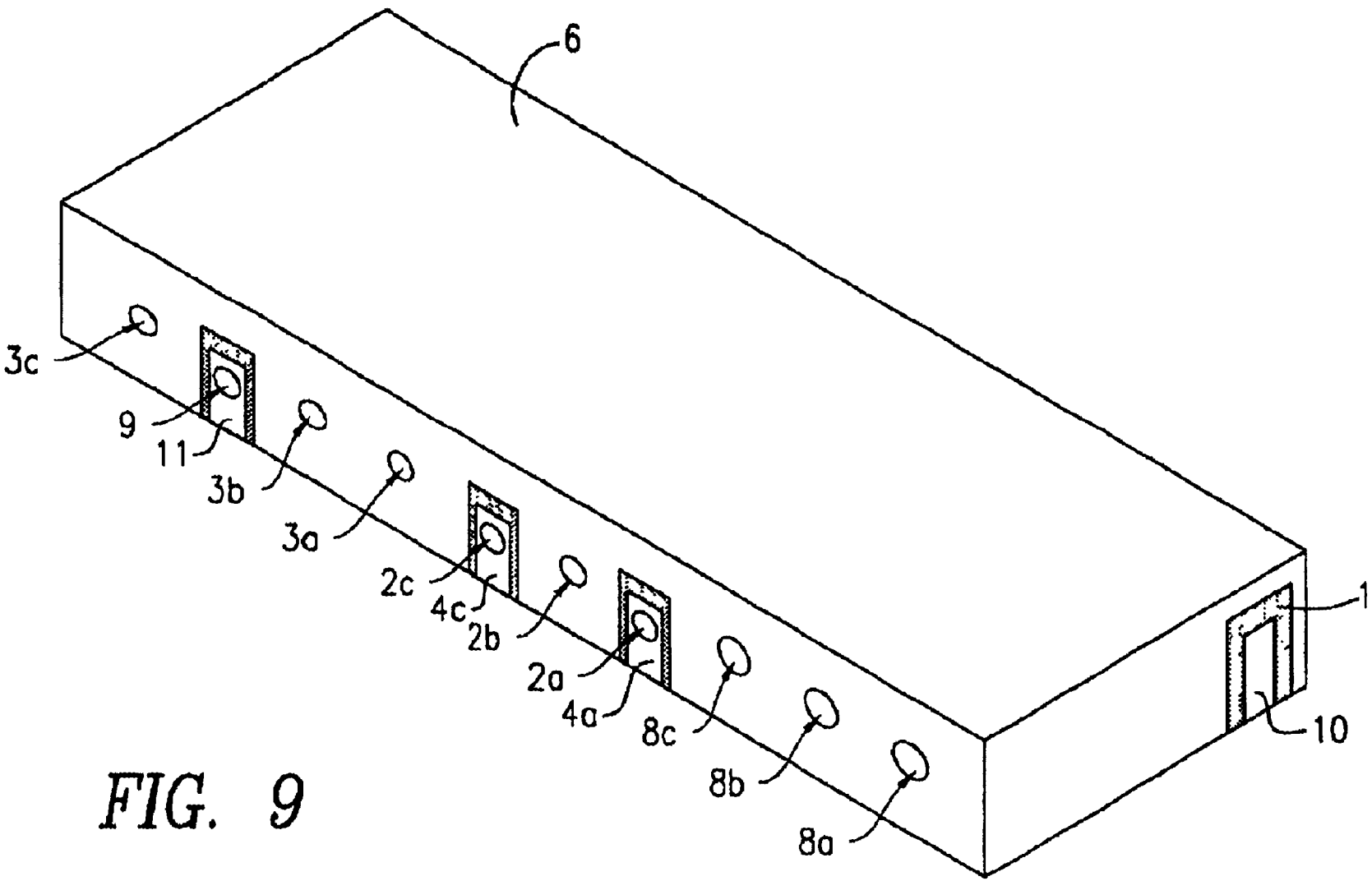
FIG. 9 is a perspective illustration of a dielectric duplexer according to another aspect of the present invention.
Figure 10:
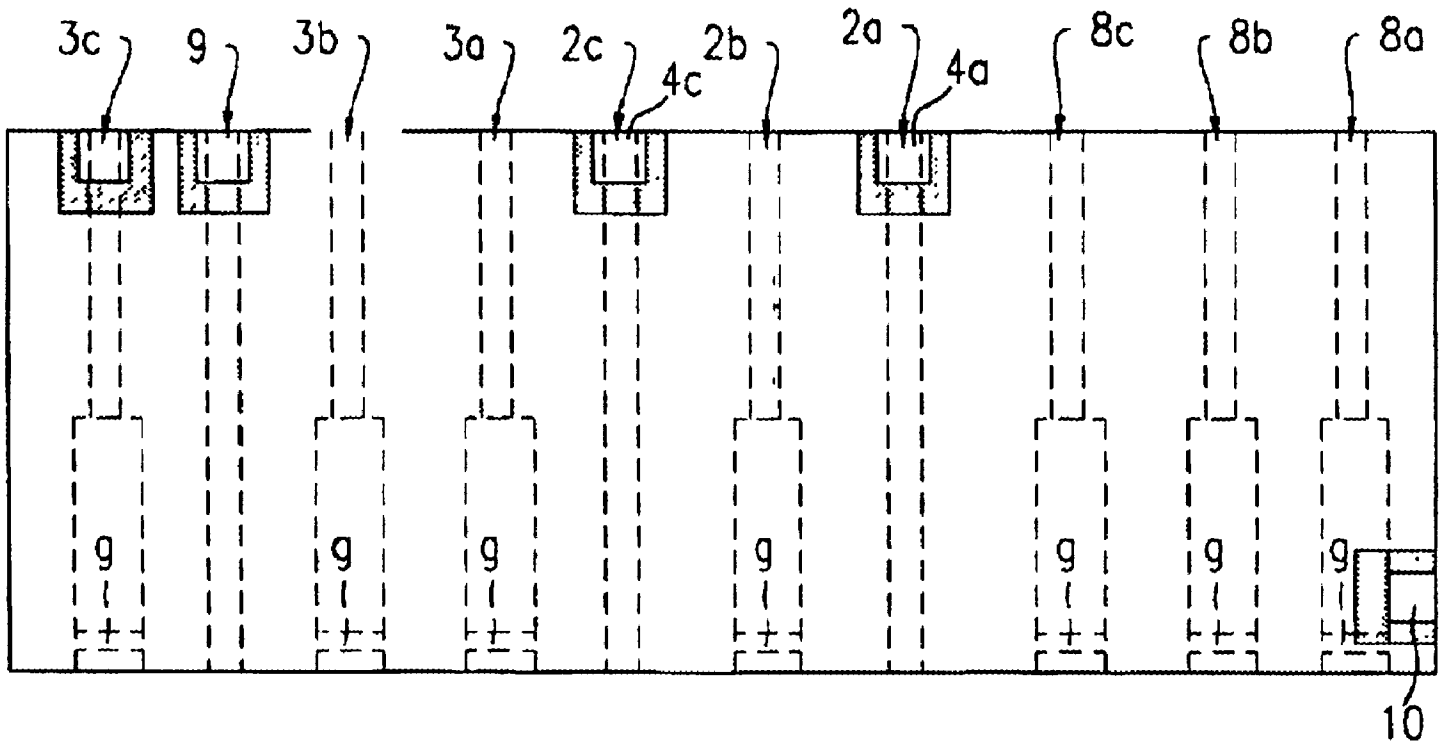
FIG. 10 is a top view of the dielectric duplexer of FIG. 9.

In the dielectric duplexer shown FIGS. 7 and 8, an unbalanced input-output terminal serving as a common input-output terminal is formed, however, in the dielectric duplexer shown in FIGS. 9 and 10, a common input-output terminal is formed of balanced input-output terminals and separate resonators are disposed on both sides of the common input-output terminal.

FIG. 9 is a perspective illustration of the dielectric duplexer and FIG. 10 is a top view of the dielectric duplexer, when seen from the mounting surface side. Ten holes 2*a* to 2*c*, 3*a* to 3*c*, 8*a* to 8*c*, and 9 are provided in a dielectric block 1, preferably formed as a substantially rectangular solid, so as to extend from one surface of the dielectric block 1 to the other opposite surface. Of these holes, the holes 2*a* to 2*c* and 9 are excitation holes and the holes 3*a* to 3*c* and 8*a* to 8*c* are resonator holes. An internal conductor is formed on the inside surface of each of the excitation holes 2*a*, 2*c*, and 9. Furthermore, an internal conductor is formed on the inside surface of each of the resonators 3*a* to 3*c* and 8*a* to 8*c* and on the inside surface of the excitation hole 2*b* and an internal-conductor-free portion g is provided in the vicinity of one opening thereof so as to form open-circuited ends.

An external conductor 6 is formed on the outside surface of the dielectric block 1 excluding the areas where the input-output terminals are provided. The excitation holes 2*a* to 2*c* and the balanced input-output terminals 4*a* and 4*c* are preferably constructed the same as those of the dielectric filter shown in each of the above embodiments. However, in this example, the excitation hole 2*b* is preferably formed as a stepped hole whose inner diameter at the open-circuit end is larger than that at the short-circuited end. Furthermore, the internal-conductor-free portion g is provided near one opening portion of the excitation hole 2*b*. Thus, the excitation holes are formed as stepped holes and the internal conductor is made open-circuited inside the excitation holes.

In each of the resonator holes 3*a* to 3*c*, an internal-conductor-free portion g is provided near one opening and the hole is formed as a stepped hole whose inner diameter at the open-circuit end is made larger than that at the short-circuited end. Of the three resonator holes, the holes 3*a* and 3*b* are preferably coupled to each other to form a two-stage resonator. Furthermore, the resonator hole 3*c* preferably functions as a trap resonator.

In the same way, the resonator holes 8*a* to 8*c* preferably function as a three-stage resonator. The hole 9 is an excitation hole and an unbalanced input-output terminal 11 is provided at the open-circuit end of the excitation hole 9. Another unbalanced input-output terminal 10 is provided near the open-circuit end of the resonator 8*a* so as to be capacitively coupled to the resonator hole 8*a*.

When the above unbalanced input-output terminal 10 is used as a transmission-signal input terminal, the unbalanced input-output terminal 11 is used as a reception-signal output terminal, the balanced input-output terminals 4*a* and 4*c* are used as an antenna terminal, and this dielectric duplexer functions as an antenna-sharing device.

Thus, when the antenna terminal is formed of balanced input-output terminals, an antenna in which a balanced signal is input and output can be directly connected. As a result, since no unbalanced-to-balanced converter is required outside the duplexer, the duplexer can be smaller as a whole.

Moreover, in FIGS. 7–10, each of the open-circuit ends is constructed such that an internal-conductor-free portion is provided near the opening portion of the resonator hole. However, one opening portion of the resonator hole may be made open-circuited, as shown in FIG. 4, and an electrode may be formed so as to generate stray capacitance between one opening of the resonator hole and the external conductor, as shown in FIG. 5. Furthermore, a coupling electrode may be formed on the surface with the openings of resonator holes to capacitively couple neighboring resonator holes.

Figure 11A:
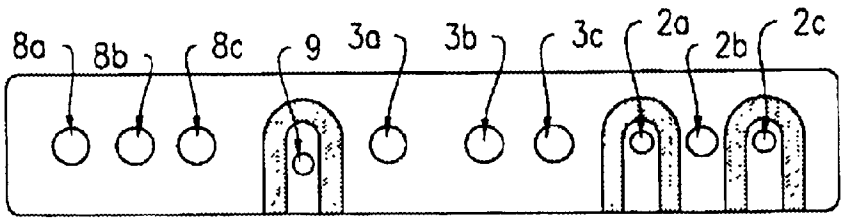
FIG. 11A is a front view of a dielectric duplexer according to a further aspect of the present invention.
Figure 11B:
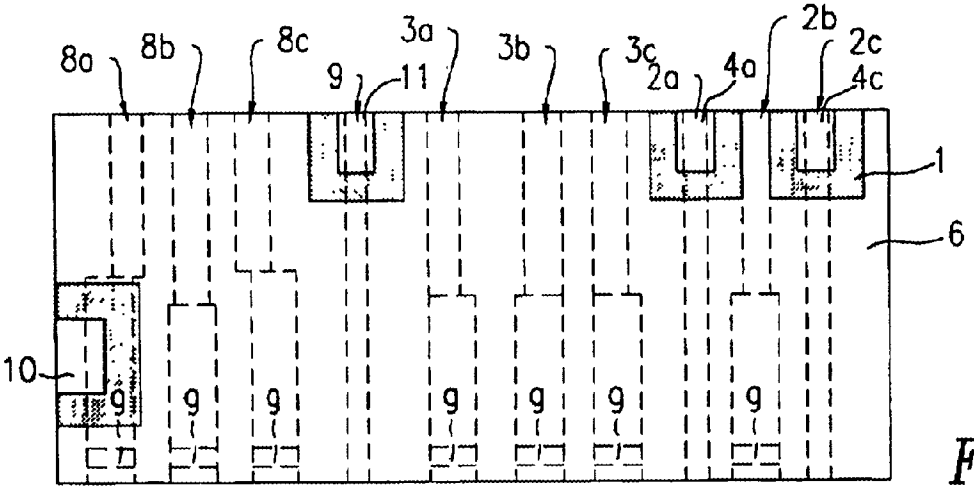
FIG. 11B is a bottom view of the dielectric duplexer of FIG. 11 A.
Figure 11C:
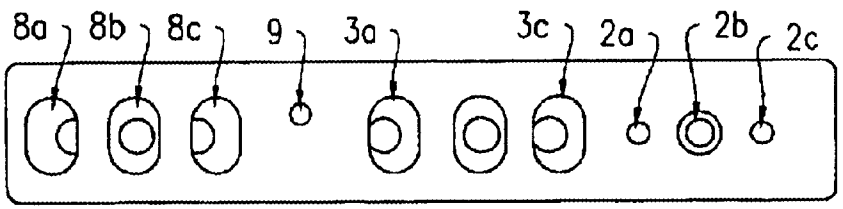
FIG. 11C is a rear view of the dielectric duplexer of FIG. 11A.
Figure 11D:
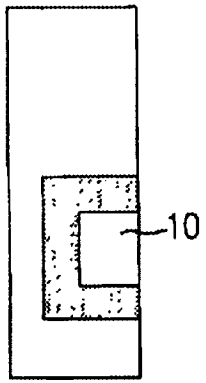
FIG. 11D is a left side view of the dielectric duplexer of FIG. 11A.

Next, the construction of a dielectric duplexer according to yet another aspect of the present invention is described with reference to FIGS. 11A, 11B, 11C, and 11D. FIG. 11A is a front view of the dielectric duplexer, FIG. 11B is a bottom view of the dielectric duplexer, FIG. 11C is a rear view of the dielectric duplexer, and FIG. 11D is a left side view of the dielectric duplexer.

Ten holes 2*a* to 2*c*, 3*a* to 3*c*, 8*a* to 8*c*, and 9 are provided in a dielectric block 1, which is preferably in the form of a substantially rectangular solid block, so as to extend from one surface of the dielectric block 1 to the other opposite surface. The holes 2*a* to 2*c* and 9 are excitation holes and the holes 3*a* to 3*c* and 8*a* to 8*c* are resonator holes. An internal conductor is formed on the inside surface of the excitation holes 2*a* to 2*c* and 9 and the resonator holes 3*a* to 3*c* and 8*a* to 8*c*. An internal-conductor-free portion g is provided near one opening of each of the resonator holes 3*a* to 3*c* and 8*a* to 8*c*. Furthermore, an internal-conductor-free portion g is provided near the opening portion of the middle excitation hole 2*b* of the three excitation holes in a row. Input-output terminals 4*a*, 4*c*, 10, 11 and an external conductor 6 are formed on the outside surface of the dielectric block 1.

When the above unbalanced input-output terminal 10 is used as a transmission-signal input terminal, the balanced input-output terminals 4*a* and 4*b* are used as a reception-signal output terminal, the unbalanced input-output terminal 11 is used as an antenna terminal, and this dielectric duplexer functions as an antenna-sharing device.

The construction of the middle excitation hole 2*b* out of the three excitation holes 2*a*, 2*b*, and 2*c* for balanced input and output is preferably different from the excitation holes 2*a* and 2*c*. In order to make the electrical length of the three excitation holes equal, the middle excitation hole 2*b* is formed as a stepped hole and an internal-conductor-free portion g is provided near the opening having a larger inner diameter. That is, the electrical length of the internal conductor of the excitation hole 2*b* is made equal to the electrical length of the internal conductor of the excitation holes 2*a* and 2*c* by changing the location of the step, the inner diameter, the location of the internal-conductor-free portion g, the gap width of the internal-conductor-free portion g, etc., of the excitation hole 2*b*.

In order to obtain good balance characteristics (characteristics in which the phase difference is 180 degrees in particular), it is desirable that the electrical lengths of the internal conductors of the three excitation holes be equal to each other and that the resonance frequency of the excitation holes (resonance frequency in the case when the internal conductor of the excitation holes is considered to be a quarter wavelength line) is a center frequency of the frequency bandwidth of a signal which is input and output. In this example, since the balanced input-output terminals 4*a* and 4*b* are used as reception-signal output terminals, the resonance frequency is set to the center frequency of the reception frequency bandwidth.

When the location and gap width of the internal-conductor-free portion g of the above middle excitation hole 2*b* are changed, the frequency at which the phase difference becomes zero is changed while the gradient of the characteristic straight line showing the balance characteristics of phase difference shown in FIG. 3A is kept nearly constant. That is, the characteristic straight line is displaced up and down. Then, the location and gap width of the internal-conductor-free portion g of the excitation hole 2*b* can be adjusted so that the phase difference becomes zero at a desired frequency.

Although the reception-signal output terminal of the duplexer is described in the example, the resonance frequency due to the excitation holes may be set so as to be substantially equal to the center frequency of the pass band in a single filter. Furthermore, when applied to the antenna terminal of the duplexer, the resonance frequency due to the excitation holes may be set so as to be substantially equal to the center frequency between the transmission frequency and the reception frequency.

Moreover, as shown in each of the above embodiments, when the three excitation holes are all straight holes and an electrode is added at the open-circuit surface of the middle excitation hole, in order to make the electrical length of the three excitation holes nearly the same, the area of the electrode added at the open-circuit surface may be made smaller or the electrode may be eliminated. Furthermore, the internal-conductor-free portion is provided so as to be in contact with the open-circuit surface and the internal conductor may be made open-circuited at the internal-conductor-free portion. Moreover, the internal-conductor-free portion may be provided at a recessed location of the opening of the excitation hole.

In order to improve the amplitude difference of the above balance characteristics, the coupling between excitation holes is adjusted by changing the pitch of the excitation holes (space between excitation holes), the inner diameter of the excitation holes, etc. Normally, the amplitude difference is made smaller by increasing the coupling. Such designing is performed by setting the location, shape, and dimensions of the three excitation holes in accordance with the required characteristics and the required external shape of the dielectric block.

Next, the construction of a communication device according to an aspect of the present invention is described with reference to FIG. 12.

Figure 12:
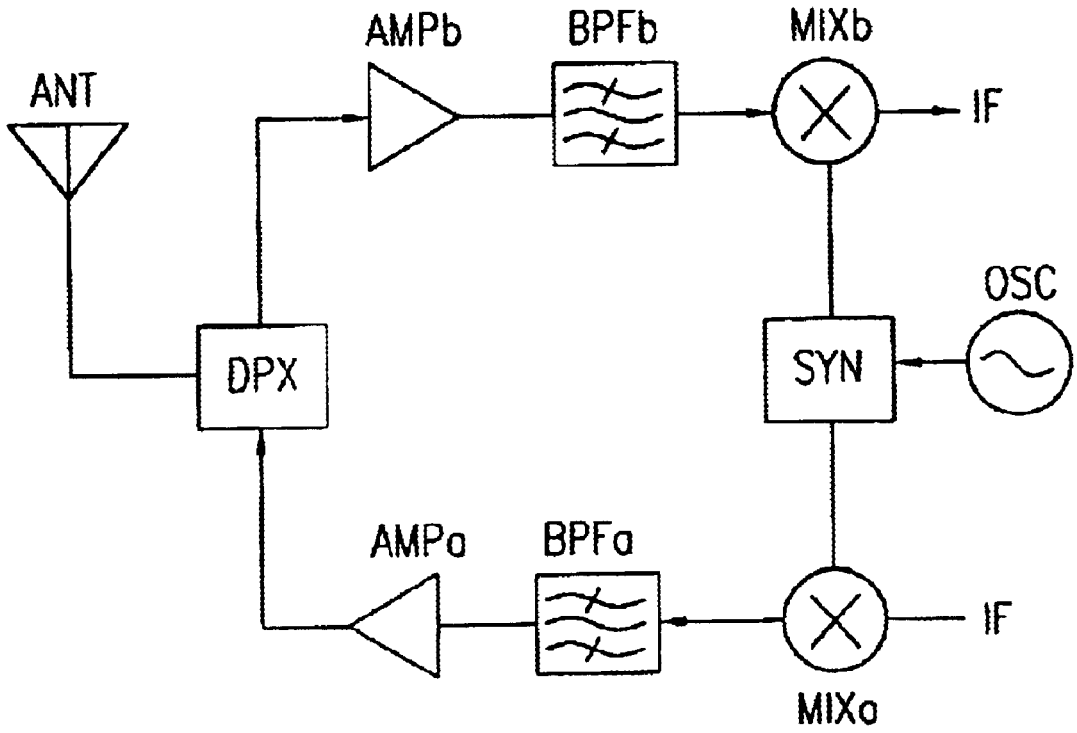
FIG. 12 is a block diagram showing the construction of a communication device according to an aspect of the present invention.

In FIG. 12, a transmission-reception antenna ANT, a duplexer DPX, bandpass filters BPFa and BPFb, amplifiers AMPa and AMPb, mixers MIXa and MIXb, an oscillator OSC, and a frequency synthesizer SYN are shown. The duplexers shown in t FIGS. 7–10 are preferably used as the above duplexer DPX. Furthermore, the filter shown in the first to fifth embodiment is used in the bandpass filters BPFa and BPFb.

The mixer MIXa mixes a transmission intermediate-frequency signal IF and a signal output from the frequency synthesizer SYN, the bandpass filter BPFa allows only the transmission frequency band in the mixed output signal from the mixer MIXa to pass, and the amplifier AMPa power-amplifies the transmission frequency band signal and transmits the signal through the duplexer DPX. The amplifier AMPb amplifies a reception signal taken out from the duplexer DPX. The bandpass filter BPFb allows only the reception frequency band out in the reception signal output from the amplifier AMPb to pass. The mixer MIXb mixes a frequency signal output from the frequency synthesizer STN and the reception signal to output a reception intermediate-frequency signal IF.

According to the present invention, since the array of three excitation holes and a resonator hole coupled to at least one of the excitation holes located on either sides of the array of three excitation holes each have an axial length nearly equal to a quarter wavelength, the dielectric filter can be made smaller as a whole. Furthermore, since the above-described balanced input-output terminals are provided at the open-circuit ends of the excitation holes on both sides of the array, the balanced input-output terminal can be disposed in a relatively small area.

Furthermore, according to a dielectric duplexer of the present invention, since a filter in which a signal is input or output through the balanced input-output terminals is provided, its use as an antenna-sharing device, for example, becomes possible and the direct connection of a balanced-input amplifier circuit, etc., becomes possible, and, as a result, the dielectric duplexer can be also made smaller.

Furthermore, according to a dielectric duplexer of the present invention, a first filter in which a signal is input or output through a balanced input-output terminal and a second filter in which a signal is input or output through an unbalanced input-output terminal are provided such that both of the input-output terminal and a common input-output terminal coupled to the above second dielectric filter are made unbalanced input-output terminals. Therefore, an unbalanced antenna signal is input and output, and the dielectric duplexer can be used as a compact antenna-sharing device.

Furthermore, according to a dielectric duplexer of the present invention, a balanced input-output antenna can be directly used by making a common input-output terminal a balanced input-output terminal. As a result, the dielectric duplexer can be made smaller.

Moreover, according to a communication device of the present invention, since a compact dielectric filter or dielectric duplexer is used and no unbalanced-to-balanced converter is required, a smaller communication device as a whole can be constructed.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dielectric filter comprising:

a dielectric block;

an array of excitation holes provided inside the dielectric block, one opening of each hole in the array being a short-circuited end and the other opening being an open-circuited end, the excitation holes in the array being interdigitally coupled to each other;

balanced input-output terminals provided at the open-circuited ends of the excitation holes at both ends of the array of excitation holes; and a resonator hole which is coupled to at least one of the excitation holes at either end of the array of excitation holes, one opening of the resonator hole forming a short-circuited end and the other opening forming an open-circuited end, the resonator hole being provided inside the dielectric block.

2. A dielectric duplexer comprising:

a first dielectric filter which is a dielectric filter as claimed in claim 1;

a second dielectric filter containing a second resonator hole which is different from the resonator hole of the first dielectric filter, the second dielectric filter being formed in the dielectric block;

a common input-output terminal coupled to the first and second dielectric filters, the common input-output terminal being formed on the dielectric block; and an input-output terminal coupled to the second dielectric filter, the input-output terminal being formed on the dielectric block.

3. The dielectric duplexer as claimed in claim 2, wherein the input-output terminal coupled to the second dielectric filter and the common input-output terminal are unbalanced input-output terminals.

4. The dielectric duplexer as claimed in claim 2, wherein the common input-output terminal is a balanced input-output terminal.

5. A communication device comprising a dielectric duplexer as claimed in claim 2.

6. The dielectric filter as claimed in claim 1, wherein the array of excitation holes is an array of three excitation holes.

7. The dielectric filter as claimed in claim 6, wherein the center excitation hole of the array of three excitation holes has its short circuited end located opposite that of the short circuited ends of the other two excitation holes.

8. The dielectric filter as claimed in claim 6, wherein the center excitation hole of the array of three excitation holes is a stepped hole.

9. A communication device comprising a dielectric filter as claimed in claim 1.

10. The dielectric filter as claimed in claim 1, wherein the resonator hole is a stepped resonator hole.

* * * * *